US005403184A

United States Patent [19]

Hosaka et al.

[11] Patent Number: 5,403,184

[45] Date of Patent: Apr. 4, 1995

[54] EXOTHERMIC APPARATUS

[75] Inventors: Masato Hosaka, Osaka; Jiro Suzuki, Nara; Akira Maenishi, Ikeda; Kyoko Itatani, Moriguchi; Haruo Ida, Kishiwada, all of Japan

[73] Assignee: Matsushita Electric Industrial Co., Ltd., Osaka, Japan

[21] Appl. No.: 62,608

[22] Filed: May 18, 1993

[30] Foreign Application Priority Data

| | | | |
|---|---|---|---|
| May 20, 1992 | [JP] | Japan | 4-127069 |
| Jul. 23, 1992 | [JP] | Japan | 4-196749 |
| Jul. 23, 1992 | [JP] | Japan | 4-196750 |
| Nov. 13, 1992 | [JP] | Japan | 4-303765 |

[51] Int. Cl.[6] ..... F23D 21/00

[52] U.S. Cl. ..... 431/170; 431/268; 431/328; 422/177; 422/191; 502/527; 126/401

[58] Field of Search ..... 431/268, 7, 350, 170, 431/328, 326, 327; 502/527; 60/723; 422/177, 180, 191; 126/407, 404, 413, 401, 414, 92 AC, 85 R

[56] References Cited

U.S. PATENT DOCUMENTS

| | | | |
|---|---|---|---|
| 4,384,843 | 5/1983 | Pfefferle | 431/7 |
| 4,445,570 | 5/1984 | Retallick . | |
| 4,467,050 | 8/1984 | Patel et al. . | |
| 4,740,408 | 4/1988 | Mochida et al. | 502/527 |

FOREIGN PATENT DOCUMENTS

| | | | |
|---|---|---|---|
| 206067 | 12/1986 | European Pat. Off. | 502/527 |
| 0380705 | 8/1990 | European Pat. Off. . | |
| 2480406 | 10/1981 | France . | |
| 2654013 | 5/1991 | France . | |
| 2037607 | 7/1980 | United Kingdom . | |
| 2092291 | 8/1982 | United Kingdom . | |
| 2243310 | 10/1991 | United Kingdom . | |

*Primary Examiner*—James C. Yeung

*Attorney, Agent, or Firm*—Wenderoth, Lind & Ponack

[57] ABSTRACT

An exothermic apparatus uses heat generated by the combustion of gas fuel or liquid fuel. The exothermic apparatus comprises a mixing section in which fuel gas and air are mixed with each other; and a casing disposed downstream of the mixing section and accommodating a combustion chamber. A fin provided in the combustion chamber is substantially parallel with the flow direction of mixed gas. A catalyst layer is in close contact with an inner surface of the combustion chamber and an outer surface of the fin. In this manner, fuel gas is efficiently brought in contact with the surface of the catalyst layer and the temperature of the catalyst is prevented from fluctuating even though heating quantity in an exothermic section changes. Thus, catalytic combustion can be reliably accomplished in the compact combustion chamber.

8 Claims, 9 Drawing Sheets

EXOTHERMIC APPARATUS

BACKGROUND OF THE INVENTION

1. Field of the Invention

The present invention relates to an exothermic apparatus, for use in an electric iron, steamer, cooking utensils, a coffee maker or the like in which gas fuel or liquid fuel is burned to utilize combustion heat as a heat source.

2. Description of the Related Arts

This kind of exothermic apparatus includes a cordless hair collar, a body warmer and the like. In the exothermic apparatus, butane gas or benzine is used as fuel which is liquefied to be mixed with air. Then, the mixed gas is brought in contact with a felt-shaped catalyst containing platinum to effect catalytic reactions. Combustion heat generated by the catalytic reactions is utilized as the heat source of the exothermic apparatus.

The combustion quantity of the exothermic apparatus is small and combustion of the mixed gas proceeds with the temperature of the catalyst kept low. In order to increase the exothermic quantity, it is necessary to increase the combustion quantity. To this end, the quantity of the mixed gas which is to react on a catalyst layer is required to be increased. As a result, some percent of the mixed gas does not react with substances of the catalyst layer and are discharged from a combustion chamber without burning. Therefore, in order to increase combustion quantity, it is necessary to increase the area in which the mixed gas contacts the catalyst layer. Consequently, the exothermic apparatus is large.

SUMMARY OF THE INVENTION

It is an object of the present invention to provide an exothermic apparatus which is compact and for which a combustion chamber is small.

It is another object of the present invention to provide an exothermic apparatus capable of providing stable combustion.

It is still another object of the present invention to provide an exothermic apparatus superior in response.

It is a further object of the present invention to provide an exothermic apparatus in which mixed gas burns reliably under the action of a catalyst.

It is still a further object of the present invention to provide an exothermic apparatus in which mixed gas starts burning rapidly.

In accomplishing this and other objects of the present invention, there is provided an exothermic apparatus comprising: a mixing section in which the fuel gas and air are mixed with each other; and a casing, disposed downstream of the mixing section, accommodating a combustion chamber. In the above construction, a fin is provided in the combustion chamber in such a manner that the fin is substantially parallel with the flow direction of mixed gas; and a catalyst layer is formed in close contact with an inner surface of the combustion chamber and an outer surface of the fin.

In the above exothermic apparatus, a gap is provided between an end of the fin disposed inside the combustion chamber and the inner surface of the combustion chamber.

The catalytic combustion is described below. Upon supply of mixed gas of fuel and air to the surface of the catalyst layer heated to an active temperature, in the vicinity of the surface of the catalyst layer, the mixed gas burns at a temperature lower than that of flame combustion under the action of the catalyst. In this manner, an exothermic reaction occurs. Accordingly, it is important to supply the mixed gas efficiently to the surface of the catalyst in order to increase the combustion rate in the catalytic combustion.

According to the above construction, the fin is provided in the combustion chamber, and the catalyst layer is formed in close contact with the outer surface of the fin. In this manner, not only the contact area between the mixed gas and the catalyst layer, but also the area of heat transfer is increased. Consequently, the heat exchange efficiency of heating a material by means of combustion heat generated on the surface of the catalyst can be remarkably increased. Accordingly, the combustion chamber can be made compact.

In catalytic combustion, the mixed gas burns on the surface of the catalyst and thus the temperature at which the mixed gas burns on the catalyst surface has a great influence on the combustion characteristic thereof. Since heat quantity is supplied from the outer surface of the combustion chamber to the material to be heated, the temperature at which the mixed gas burns on the surface of the catalyst layer may be changed according to the fluctuation of heating amount supplied to the material to be heated. Not only the combustion heat generated on the inner surface of the combustion chamber, but also the combustion heat generated on the surface of the catalyst layer in close contact with the outer surface of the fin is transferred to the exothermic section disposed on the outer surface of the combustion chamber via the fin, thus contributing to the heating of the material to be heated. Since the catalyst layer in close contact with the outer surface of the fin is not in contact with the exothermic section, the catalyst layer is hardly subjected to the influence of the fluctuation in the heating amount supplied to the exothermic section, and thus the surface of the catalyst layer is kept at a high temperature. Accordingly, the mixed gas is allowed to burn reliably on the surface of the catalyst layer. Further, there is a supply of the combustion heat from the surface of the catalyst layer on which the mixed gas burns at a high temperature to the catalyst layer in close contact with the inner surface off the combustion chamber as radiation heat. Consequently, the fluctuation in the combustion temperature of the catalyst layer can be prevented notwithstanding the fluctuation in the heating amount supplied to the material to be heated.

There is also provided an exothermic apparatus comprising: a mixing section in which the fuel gas and air are mixed with each other; and a casing, downstream of the mixing section, accommodating a combustion chamber. In this construction, a plurality of fins is provided alternately on an upper surface of the combustion chamber and a lower surface thereof in such a manner that the fins are substantially parallel with the flow direction of mixed gas; a gap is provided between an end of each fin and the upper surface of the combustion chamber as well as the lower surface thereof; and a catalyst layer is formed in close contact with an inner surface of the combustion chamber and an outer surface of the fin.

According to the above construction, the fins are provided alternately on the upper surface of the combustion chamber and the lower surface thereof in such a manner that the fins are substantially parallel with the flow direction of mixed gas. The gap is provided between the end of each fin and the upper surface of the combustion chamber as well as the lower-surface thereof. The catalyst layer is formed in close contact with the inner surface of the combustion chamber and the outer surface of the fin. Therefore, the combustion chamber is compact and thus the exothermic apparatus is compact. That is, the fins are provided inside the combustion chamber. The catalyst layer is in close contact with the outer surface of the fin. In this manner, the area of the catalyst is great without changing the size of the combustion chamber. In addition, the fins are provided alternately on the upper surface of the combustion chamber and the lower surface thereof. As a result, premixed gas passes through the combustion chamber with the fins dispersing the premixed gas supplied into the combustion chamber substantially uniformly in the combustion chamber. Accordingly, the premixed gas contacts the surface of the catalyst efficiently and almost all the premixed gas is discharged from the combustion chamber after contacting the surface of the catalyst. Thus, the combustion efficiency in the combustion chamber can be greatly improved.

Further, the fins provided in the combustion chamber increase not only the area of the catalyst, but also the heat transfer area. Consequently, the combustion heat generated over the surface of the catalyst can be efficiently transferred to a material to be heated. Thus, the combustion chamber can be made compact.

There is also provided an exothermic apparatus comprising: a mixing chamber in which the fuel gas and air are mixed with each other; a combustion chamber, provided downstream of the mixing chamber, in which a catalyst layer composed of a ceramic coating layer containing catalyst metal is in close contact with an inner surface thereof; and a casing accommodating the combustion chamber. In this construction, two discharge openings perpendicular to the flow direction of mixed gas and symmetrical with respect to the center of the combustion chamber are disposed in the vicinity of an inner surface, of the combustion chamber, opposed to an entrance of the mixed gas.

According to the above construction, the discharge opening is not formed on the inner surface, of the combustion chamber, opposed to the gas entrance of the mixing chamber. The two discharge openings symmetrical with respect to the center of the combustion chamber are formed in the vicinity of the inner surface, of the combustion chamber, opposed to the gas entrance such that the discharge openings are perpendicular to the flow direction of the mixed gas. That is, since the discharge opening is not disposed in the neighbor hood of the combustion chamber, the resistance to the flow of the mixed gas is great in the vicinity of the center region, of the combustion chamber, in which the mixed gas flows fast. Consequently, the mixed gas flows slowly in this region. The discharge openings are disposed in the vicinity, of the inner surface of the combustion chamber, in which the mixed gas flows slowly. As a result, the resistance to the flow of the mixed gas is small in the vicinity of the inner surface of the combustion chamber. As a result, the mixed gas flows faster in the vicinity of the inner surface of the combustion chamber than in the vicinity of the center region thereof. That is, the original speed of the mixed gas and the resistance to the flow speed thereof offset each other in each region. As a result, the entire mixed gas flows at a uniform speed in the combustion chamber. Therefore, the catalytic combustion can be reliably accomplished.

There is also provided an exothermic apparatus comprising: a mixing chamber in which the fuel gas and air are mixed with each other; a combustion chamber, provided downstream of the mixing chamber, in which a catalyst layer composed of a ceramic coating layer containing catalyst metal is in close contact with an inner surface thereof; and a casing accommodating the combustion chamber. In this construction, a discharge opening perpendicular to the flow direction of mixed gas is disposed in the vicinity of an inner surface, of the combustion chamber, opposed to an entrance of the mixed gas; and an igniter is provided on the inner surface, of the combustion chamber, opposed to the discharge opening.

According to this invention, the discharge opening is formed in the vicinity of the inner surface, of the combustion chamber, opposed to the gas entrance thereof such that the discharge opening is perpendicular to the flow direction of the mixed gas. The igniter is provided on the inner surface, of the combustion chamber, opposed to the discharge opening. Accordingly, the mixed gas can be reliably ignited without decreasing the area of the catalyst disposed on the inner surface, of the combustion chamber, opposed to the gas entrance. Accordingly, due to heat transfer and radiation, there occurs a supply of the combustion heat from the catalyst layer having a high temperature and in close contact with the inner surface, of the combustion chamber, opposed to the gas entrance of the combustion chamber to the catalyst layer disposed at other places in the combustion chamber. In this combustion control of the modification, the position at which catalytic combustion starts earliest is the catalyst layer in close contact with the inner surface, of the combustion chamber, opposed to the gas entrance most downstream of the combustion chamber. Therefore, when the fuel gas is supplied from the catalyst layer to the combustion chamber, radiation heat is uniformly supplied to the other catalyst layer. In this manner, the mixed gas disposed over other catalyst layer starts combustion rapidly.

There is also provided an exothermic apparatus comprising: a mixing section, in which the fuel gas and air are mixed with each other; a combustion chamber, disposed downstream of the mixing section, having a catalyst layer in close contact with an inner surface thereof; and a casing accommodating the combustion chamber. In this construction, the catalyst layer is composed of a ceramic coating layer containing catalyst metal disposed in the vicinity of a flow passage surface of the mixed gas.

According to this construction, upon supply of mixed gas of fuel and air to the surface of the catalyst layer heated to an active temperature, the mixed gas burns over the surface of the catalyst. In this manner, an exothermic reaction occurs. The catalyst layer comprises the ceramic coating layer containing the catalyst metal in the vicinity of the surface of the passage of the mixed gas. That is, the catalyst layer comprises a first layer consisting of the catalyst metal and disposed in the vicinity of the surface of the flow passage of the mixed gas and a second layer not containing the catalyst metal and disposed on the exothermic section side.

Since the second layer serves as a heat-insulating layer, it is capable of preventing combustion heat from being transferred from the combustion chamber to the exothermic section to a great extent. Thus, the temperature over the catalyst can be kept in an appropriate state and thus a reliable catalytic combustion occurs.

There is also provided an exothermic apparatus comprising: a mixing section in which the fuel gas and air are mixed with each other; a combustion chamber, disposed downstream of the mixing section, having a catalyst layer in close contact with an inner surface thereof; and a casing accommodating the combustion chamber. In this construction, an igniter is provided on the inner surface of the combustion chamber, of the combustion chamber, opposed to the gas entrance of the combustion chamber; and a discharge opening, perpendicular to the flow direction of the mixed gas, disposed in the vicinity of the igniter.

There is also provided an exothermic apparatus comprising: a mixing section in which the fuel gas and air are mixed with each other; a combustion chamber, disposed downstream of the mixing section, having a catalyst layer in close contact with an inner surface thereof; and a casing accommodating the combustion chamber. In this construction, a flow-obstructing section for obstructing the flow of the mixed gas is disposed in the vicinity of a discharge opening provided inside the combustion chamber; and an igniter is provided downstream of the flow-obstructing section.

According to the above construction, the fuel gas jetted from a nozzle draws air in the periphery of the nozzle due to the inducing operation of the flow of the fuel gas. Air and the fuel gas are uniformly mixed with each other in the mixing chamber, and the mixed gas is supplied to the combustion chamber. Then, the mixed gas flows in the combustion chamber, thus colliding with the inner surface, of the combustion chamber, opposed to the gas entrance thereof and being discharged from the discharge opening. A stagnant region in which the mixed gas flows very slowly is generated in the vicinity of the inner surface, of the combustion chamber, opposed to the gas entrance thereof. The igniter is disposed in the vicinity of the inner surface, of the combustion chamber, opposed to the gas entrance thereof so that the leading end of a plug is disposed in the stagnant region. Sparks are generated from the leading end of the plug. In this manner, the mixed gas can be ignited easily.

Due to the provision of the flow-obstructing section, a stagnant region in which the mixed gas flows very slowly is generated. Sparks are generated by the igniter from the leading end of the plug disposed in the stagnant region. In this manner, the mixed gas can be ignited easily.

While flame generated at this time is propagating upstream in the combustion chamber, the catalyst layer in close contact with the inner surface of the combustion chamber is heated. Since the catalyst layer is heated by utilizing the propagation of flame, the catalyst layer attains the active temperature in a short period of time.

There is also provided an exothermic apparatus comprising: a mixing section in which the fuel gas and air are mixed with each other; a combustion chamber, disposed downstream of the mixing section, having a ceramic coating layer containing catalyst; and a discharge opening substantially perpendicular to the flow direction of mixed gas. In this construction, the quantity of metal contained in a first catalyst layer formed on an inner surface, of the combustion chamber, opposed to a gas entrance contains metal is greater than that of metal contained in a second catalyst layer formed on other inner surface of the combustion chamber.

According to the above construction, the apparatus has a high response in combustion reaction with the catalyst layer, having a greater amount of metal, serving as a combustion point. That is, a catalyst layer containing a large quantity of metal has a higher activity than a catalyst layer containing a small quantity of metal. In particular, a catalyst layer having a low temperature is slow in starting catalytic combustion. There is a difference in rise time between catalyst layers depending on the quantity of the catalyst metal contained therein. That is, when the temperatures of catalyst layers in the combustion chamber are equal to each other, the combustion starts earliest over the catalyst layer in close contact with the inner surface, of the combustion chamber, opposed to the gas entrance thereof. Accordingly, the other catalyst layer can be rapidly heated by the heat and radiation supplied from the catalyst layer which is in close contact with the gas entrance and has been heated to a high temperature. According to the combustion control, the position at which the mixed gas starts burning under the influence of the catalyst is constant when the fuel gas is supplied to the combustion chamber. In this manner, the combustion of the mixed gas can be reliably accomplished. Further, since the mixed gas starts combustion over the catalyst layer in close contact with the inner surface which is opposed to the gas entrance and most downstream of the combustion chamber, the radiation heat of the catalyst layer is uniformly supplied to the other catalyst layers in the combustion chamber and the mixed gas disposed over other catalyst layer starts combustion rapidly.

There is also provided an exothermic apparatus comprising: a mixing section in which the fuel gas and air are mixed with each other; a combustion chamber, disposed downstream of the mixing section, having a ceramic coating layer containing catalyst; and a discharge opening substantially perpendicular to the flow direction of mixed gas. In this construction, the ceramic coating layer of a first catalyst layer in close contact with an inner surface, of the combustion chamber, opposed to a gas entrance thereof is thicker than a second catalyst layer in close contact with other inner surface of the combustion chamber.

According to the above construction, the apparatus has a high response in combustion reaction with the start position of catalytic combustion fixed. That is, the mixed gas supplied to the combustion chamber flows therein. As soon as the mixed gas collides with the inner surface opposed to the gas entrance of the combustion chamber, the catalytic combustion of the mixed gas starts earliest over the catalyst layer. The other catalyst layer can be rapidly heated by the heat and radiation supplied from the catalyst layer which is in close contact with the gas entrance and has been heated to a high temperature. According to the combustion control of the second modification, the position at which the mixed gas starts burning under the influence of the catalyst is constant when the fuel gas is supplied to the combustion chamber. In this manner, the combustion of the mixed gas can be reliably accomplished. Further since he mixed gas starts combustion over the catalyst layer in close contact with the inner surface which is opposed to the gas entrance and most downstream of the combustion chamber, the radiation heat of the catalyst layer is uniformly supplied to the other catalyst layer in the combustion chamber and the mixed gas disposed over other catalyst layer starts combustion rapidly.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
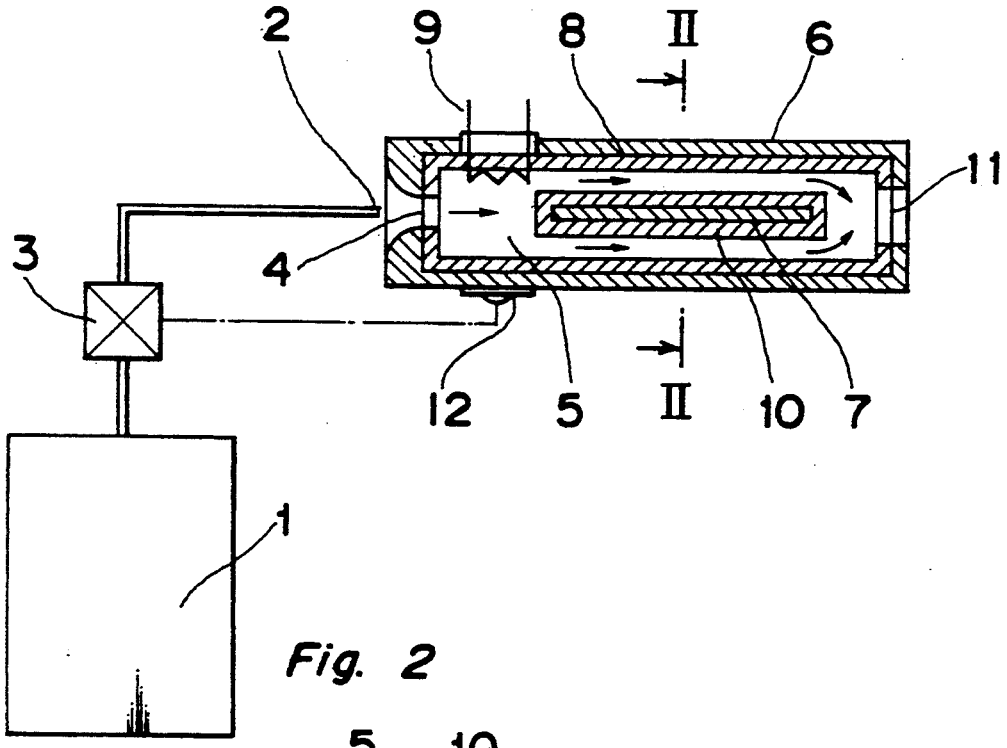
FIG. 1 is a horizontal sectional view showing an exothermic apparatus according to a first embodiment of the present invention.

Before the description of the present invention proceeds, it is to be noted that like parts are designated by like reference numerals throughout the accompanying drawings.

An exothermic apparatus according to the embodiments of the present invention will be described below with reference to the drawings.

Figure 2:
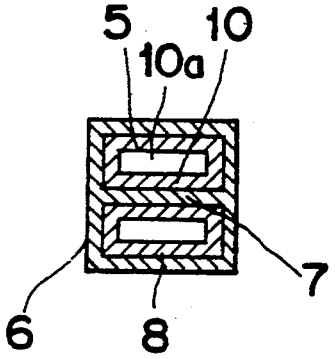
FIG. 2 is a sectional view, showing the exothermic apparatus, taken along a line II—II of FIG. 1.
Figure 3:
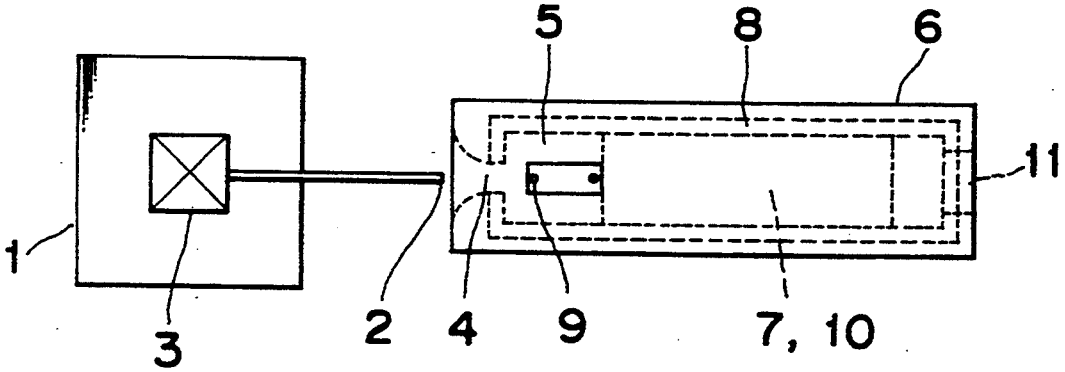
FIG. 3 is a plan view of the exothermic apparatus shown in FIG. 1.

An exothermic apparatus according to the first embodiment of the present invention is described below with reference to FIGS. 1, 2, 3, and 4. FIG. 1 is a horizontal sectional view showing the exothermic apparatus according to the first embodiment of the present invention. FIG. 2 is a sectional view, showing the exothermic apparatus, taken along the line II—II of FIG. 1. FIG. 3 is a plan view of the exothermic apparatus of FIG. 1. A valve 3 provided between a bomb (or fuel gas tank) 1 containing liquefied gas such as propane gas, butane gas or the like and a nozzle 2 controls the flow rate of fuel gas supplied thereto from the bomb 1. The fuel gas jetted from the nozzle 2 sucks air in the periphery of the nozzle 2 due to the inducing operation of the flow of the fuel gas. Air and the fuel gas are uniformly mixed with each other in a mixing chamber 4 and the mixture of air and the fuel gas is supplied to a combustion chamber 5. The combustion chamber 5 is disposed inside an exothermic section 6 comprising a metal casing. A fin 7 disposed inside the combustion chamber 5 is substantially parallel with the flow direction of the mixed gas so as to increase the heat transfer area. In this manner, the combustion heat generated on the surface of a catalyst can be efficiently transmitted to a material to be heated.

A catalyst layer 8 is disposed in the combustion chamber 5 is in close contact with the inner surface thereof. An ignition heater 9 made of a fine platinum wire is heated by a battery (not shown), and the catalyst layer 8 close to the ignition heater 9 is also heated to a high temperature. When the catalyst layer 8 is heated to an active temperature, the valve 3 is opened, thus supplying the fuel gas to the mixing section 4 via the nozzle 2. The operation is performed at this time by monitoring the temperature in the combustion chamber 5 or opening the valve 3 a certain period of time after electricity is supplied to the ignition heater 9. The fuel gas and air are mixed with each other in the mixing section 4, and the mixed gas is supplied to the combustion chamber 5. When the mixed gas is supplied to the surface of the catalyst layer 8 heated to the active temperature, the mixed gas starts burning on the surface of the catalyst layer 8. In the neighborhood of the combustion chamber 5, the mixed gas supplied to the vicinity of the inner surface of the combustion chamber 5 burns while the mixed gas supplied to the vicinity of the center of the combustion chamber 5 passes through the combustion chamber 5 without burning. Accordingly, gas which has burned flows in the vicinity of the inner surface of the combustion chamber 5, whereas the mixed gas flows in the vicinity of the center of the combustion chamber 5.

The fin 7 provided inside the combustion chamber 5 is substantially parallel with the flow direction of the mixed gas. A catalyst layer 10 is in close contact with the outer surface of the fin 7. Therefore, the mixed gas collides with a burning surface 10*a* of the fin 7 and as a result, unburned gas of the mixed gas partly burns on the burning surface 10*a*. There occurs a mixture between the gas which has burned on the burning surface 10*a* as well as in the vicinity of the entrance of the combustion chamber 5 and the unburned fuel gas. The mixed gas flows between the catalyst layer 10 in close contact with the outer surface of the fin 7 and the catalyst layer 8 in close contact with the inner surface of the combustion chamber 5. As a result of the mixture between the gas which has burned and has a high temperature and the unburned fuel gas, the temperature of the fuel gas becomes high. While the fuel gas which has become high in temperature is flowing in the narrow gap between the catalyst layers 8 and 10, all of the unburned gas burns. If the gap between the catalyst layers 8 and 10 is very large, the combustion efficiency of the mixed gas is unfavorable and thus all of the unburned gas does not burn. A porous fiber-shaped material was adhered to a combustion chamber made of aluminum with the gap between the catalyst layers 8 and 10 varied as an experiment. The experiment indicated that a combustion chamber in which the gap between the catalyst layers 8 and 10 was less than 4mm provided a great effect in increasing the temperature of the fuel gas.

Since the gas which has burned flows in the narrow gap between the catalyst layers 8 and 10, it flows fast and the passage in which the gas which has burned flows has a high heat transfer efficiency, thus improving the heat transfer efficiency in the exothermic section 6.

In catalytic combustion, the mixed gas burns on the surface of the catalyst and thus the temperature at which the mixed gas burns on the catalyst surface has a great influence on the combustion characteristic thereof. Since heat quantity is supplied from the outer surface of the combustion chamber 5 to the exothermic section 6 as well as a material to be heated, the temperature at which the mixed gas burns on the surface of the catalyst layer 8 may be changed according to the fluctuation of heating amount supplied to the material to be heated. Not only the combustion heat generated on the inner surface of the combustion chamber 5, but also the combustion heat generated on the surface of the catalyst layer 10 in close contact with the outer surface of the fin 7 is transferred to the exothermic section 6 disposed on the outer surface of the combustion chamber 5 via the fin 7, thus contributing to the heating of the material to be heated. Since the catalyst layer 10 in close contact with the outer surface of the fin 7 is not in contact with the exothermic section 6, the catalyst layer 10 is hardly subjected to the influence of the fluctuation in the heating amount supplied to the exothermic section 6, and thus the surface of the catalyst layer 10 is kept at a high temperature. Accordingly, the mixed gas is allowed to burn reliably on the surface of the catalyst layer 10. Further, there is a supply of the combustion heat from the surface of the catalyst layer 10 on which the mixed gas burns at a high temperature to the catalyst layer 8 in close contact with the inner surface of the combustion chamber 5 as radiation heat. Consequently, the fluctuation in the combustion temperature of the catalyst layer 8 can be prevented notwithstanding the fluctuation in the heating amount supplied to the material to be heated.

The catalytic combustion is described below. Upon supply of mixed gas of fuel and air to the surface of the catalyst layer heated to an active temperature, in the vicinity of the surface of the catalyst layer, the mixed gas burns at a temperature lower than that of flame combustion under the action of the catalyst. In this manner, an exothermic reaction occurs. Accordingly, it is important to supply the mixed gas efficiently to the surface of the catalyst in order to increase the combustion rate in the catalytic combustion.

As described above, in catalytic combustion, the mixed gas burns on the surface of the catalyst and thus the temperature at which the mixed gas burns on the catalyst surface has a great influence on the combustion characteristic thereof. Since heat quantity is supplied from the outer surface of the combustion chamber to the material to be heated, the temperature at which the mixed gas burns on the surface of the catalyst layer may be changed according to the fluctuation of heating amount supplied to the material to be heated. Not only the combustion heat generated on the inner surface of the combustion chamber, but also the combustion heat generated on the surface of the catalyst layer in close contact with the outer surface of the fin is transferred to the exothermic section disposed on the outer surface of the combustion chamber via the fin, thus contributing to the heating of the material to be heated. Since the catalyst layer in close contact with the outer surface of the fin is not in contact with the exothermic section, the catalyst layer is hardly subjected to the influence of the fluctuation in the heating amount supplied to the exothermic section, and thus the surface of the catalyst layer is kept at a high temperature. Accordingly, the mixed gas is allowed to burn reliably on-the surface of the catalyst layer. Further, there is a supply of the combustion heat from the surface of the catalyst layer on which the mixed gas burns at a high temperature to the catalyst layer in close contact with the inner surface of the combustion chamber as radiation heat. Consequently, the fluctuation in the combustion temperature of the catalyst layer can be prevented notwithstanding the fluctuation in the heating amount supplied to the material to be heated.

Figure 4:
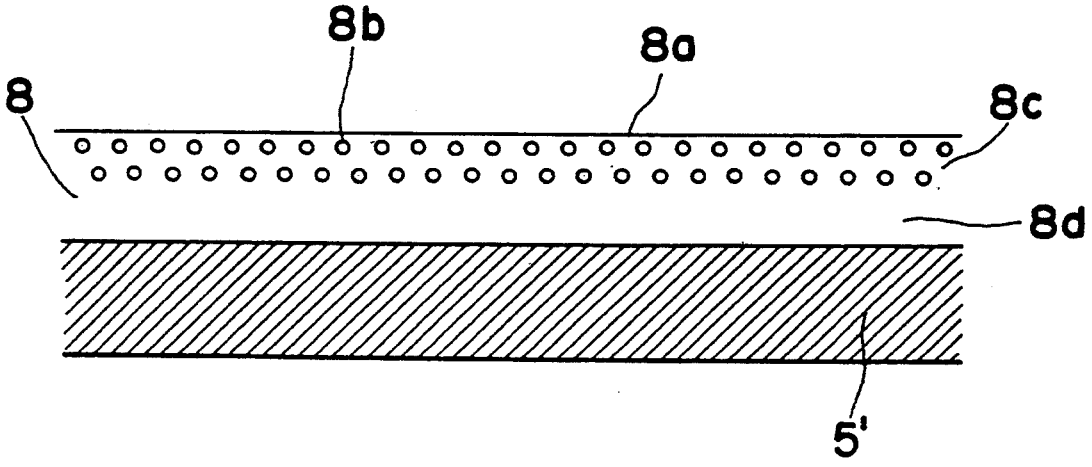
FIG. 4 is a sectional view in which a part of the exothermic apparatus of FIG. 1 is enlarged.

The catalyst layer 8 is constructed as shown in FIG. 4. A ceramic coating layer 8*a* is formed on the inner surface 5' of the combustion chamber 5. The ceramic coating layer 8*a* is formed as follows: A braided material of ceramic fiber or felt is adhered to the inner surface 6 with an adhesive agent. It is possible to coat the braided material of ceramic fibber or felt with alumina to which ceramic powders of active alumina, a rare earth element or the like having a high specific surface have been added. The inner surface 5' may be coated with alumina to which ceramic powders alumina, a rare earth element or the like having a high specific surface have been added. Instead of the braided material of ceramic fiber or felt, floc consisting of long ceramic fibers cut to 0.3 mm to 10 mm is electrolyzed and treated electrostatically to be napped on the inner surface 5'.

After the ceramic coating layer 8*a* is formed on the inner surface 5' of the combustion chamber 5, a catalyst metal 8*b* is held in the ceramic coating layer 8*a*. The catalyst metal formed in this manner does not permeate into the ceramic coating layer 8*a* but is held in the vicinity of the surface, of the ceramic coating layer 8*a*, on which the mixed gas flows. As shown in FIG. 4, the ceramic coating layer 8*a* comprises a first layer 8*c* consisting of the catalyst metal 8*b* and a second layer 8*d* not containing the catalyst metal 8*b*.

Since the catalyst metal 8b is not contained in the second layer 8d of the ceramic coating layer 8a, the second layer 8d is not capable of making a catalytic reaction, but is only a ceramic coating layer having a porous structure. However, since the second layer 8d contains a large number of air holes, it has a high heat-insulating performance. Therefore, the second layer 8d serves as a means for maintaining temperature of the first layer 8c making a catalytic reaction.

Accordingly, the second layer 8d adjusts the balance of the quantity of the heat transfer between the catalyst layer 8 and the exothermic section, prevents the exothermic section from being supercooled, and prevents the catalytic reaction from being stopped even though the temperature of the catalyst layer drops, thus contributing to a reliable catalytic combustion.

The gas which has burned cleanly in the combustion chamber 5 is discharged from a discharge opening 11. A temperature detecting section 12 is provided in the exothermic section 6. The temperature detecting section 12 has a function of adjusting the combustion quantity of the mixed gas. That is, the temperature detecting section 12 monitors the temperature of the exothermic section 6 and transmits a signal indicating the temperature thereof to the valve 3 so as to adjust the opening of the valve 3. Consequently, the surface temperature of the exothermic section 6 is maintained constant and thus the material can be heated at an appropriate temperature.

Figure 5:
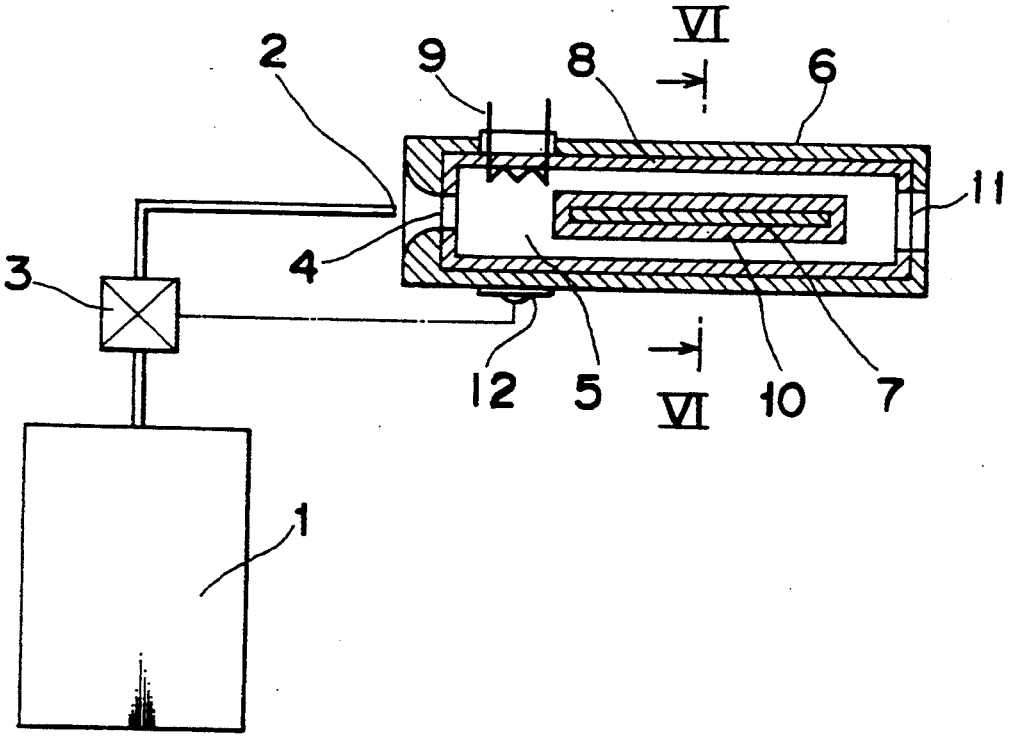
FIG. 5 is a horizontal sectional view showing an exothermic apparatus according to a modification of the exothermic apparatus according to the first embodiment.
Figure 6:
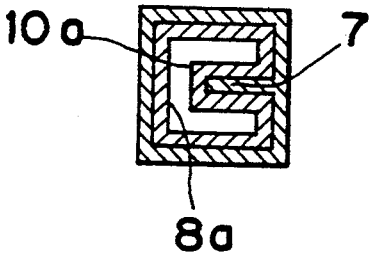
FIG. 6 is a sectional view, showing the exothermic apparatus, taken along a line VI—VI of FIG. 5.
Figure 7:
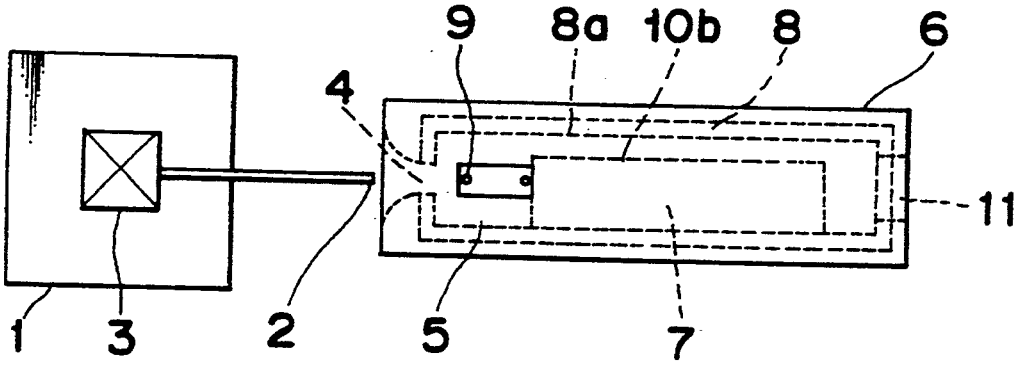
FIG. 7 is a plan view of the exothermic apparatus shown in FIG. 5.

An exothermic apparatus according to a modification of the exothermic apparatus according to the first embodiment is described below with reference to FIGS. 5, 6, and 7. FIG. 5 is a horizontal sectional view showing the combustion chamber 5 of the exothermic apparatus. FIG. 6 is a sectional view, showing the combustion chamber 5, taken along the line VI—VI of FIG. 5. FIG. 7 is a plan view of the combustion chamber of FIG. 5. A gap is provided between an end of the fin 7 disposed inside the combustion chamber 5 and the inner surface of the combustion chamber 5 so as to form a gap between an upper surface 10b of the catalyst layer 10 and a catalyst layer 8' in close contact with the inner surface of the combustion chamber 5. In this manner, catalytic combustion can be accomplished even on the surface 10b of the catalyst layer 10 disposed at the tip end (or free end) of the fin 7. That is, the effective area of the catalyst can be increased to perform catalytic combustion and thus the combustion efficiency of the mixed gas is preferable. In addition, there is a supply of combustion heat from the upper surface 10b of the catalyst layer 10 disposed on the end of the fin 7 to the catalyst layer 8e in close contact with the inner surface of the combustion chamber 5 as radiation heat. Consequently, radiation heat is supplied upward to the combustion chamber 5 from the lower surface of the catalyst layer 8. Thus, the temperature of the catalyst layer 8e disposed on the inner surface of the combustion chamber 5 can be prevented from being fluctuated even though the heating amount supplied to the material-to be heated fluctuates. In this manner, the activity of the catalyst can be maintained.

Further, the gap formed between the tip end (or free end) of the fin 7 disposed inside the combustion chamber 5 and the inner surface of the combustion chamber 5 enlarges the sectional area of the flow passage of the mixed gas in the combustion chamber 5. As a result, the pressure loss inside the combustion chamber 5 is small and air in the periphery of the nozzle 2 can be easily drawn in by the inducing operation of the fuel gas jetted from the nozzle 2. Thus, air to be used for combustion can be reliably supplied to the combustion chamber 5.

As described above, according to the first embodiment, the exothermic apparatus comprises: the mixing section in which the fuel gas and air are mixed with each other; and the casing, disposed downstream of the mixing section, accommodating the combustion chamber. In the above construction, the fin is provided in the combustion chamber in such a manner that the fin is substantially parallel with the flow direction of mixed gas, and the catalyst layer is formed in close contact with the inner surface of the combustion chamber and the outer surface of the fin. Accordingly, the fuel gas can be brought in contact with the surface of the catalyst layer efficiently. Further, the fluctuation in the temperature of the catalyst layer can be prevented even though the heating amount supplied to the exothermic section varies. Thus, a compact exothermic apparatus can be manufactured.

Figure 8:
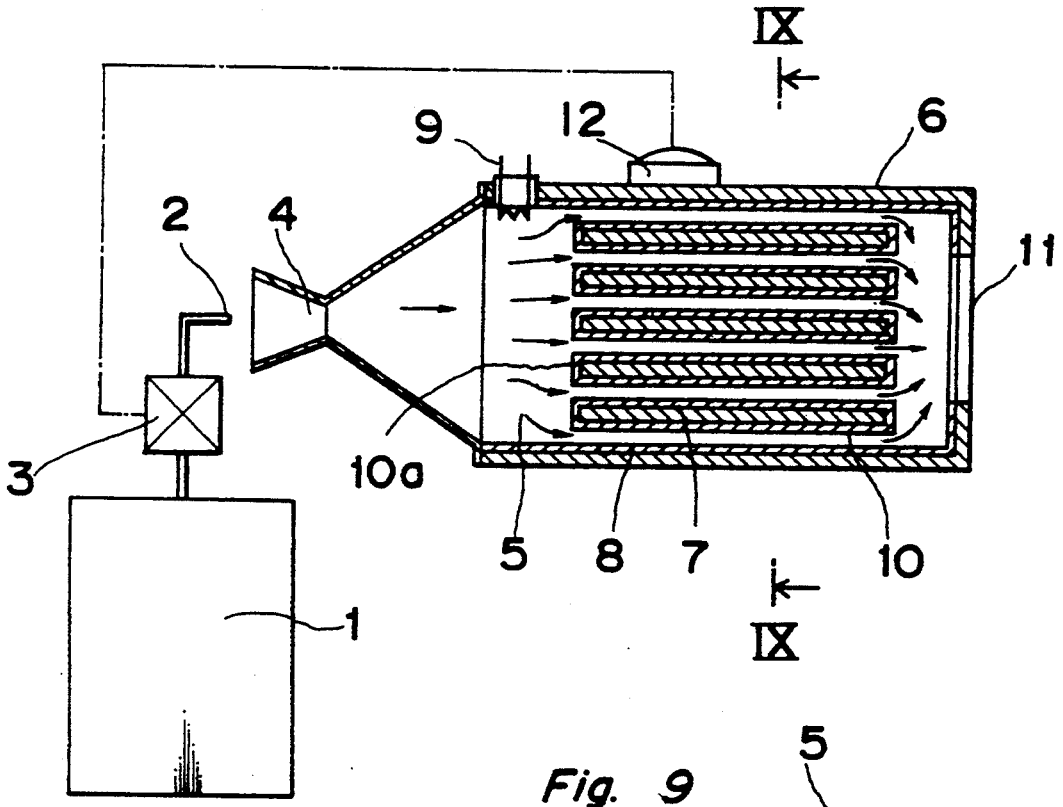
FIG. 8 is a horizontal sectional view showing an exothermic apparatus according to a second embodiment of the present invention.
Figure 9:
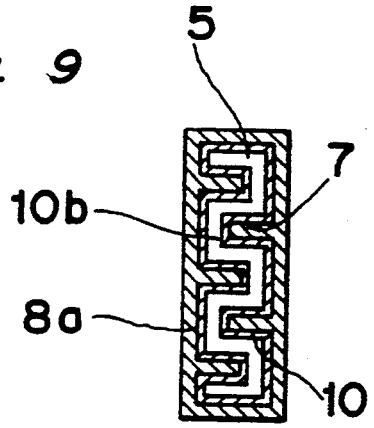
FIG. 9 is a sectional view, showing the exothermic apparatus, taken along a line IX—IX of FIG. 8.
Figure 10:
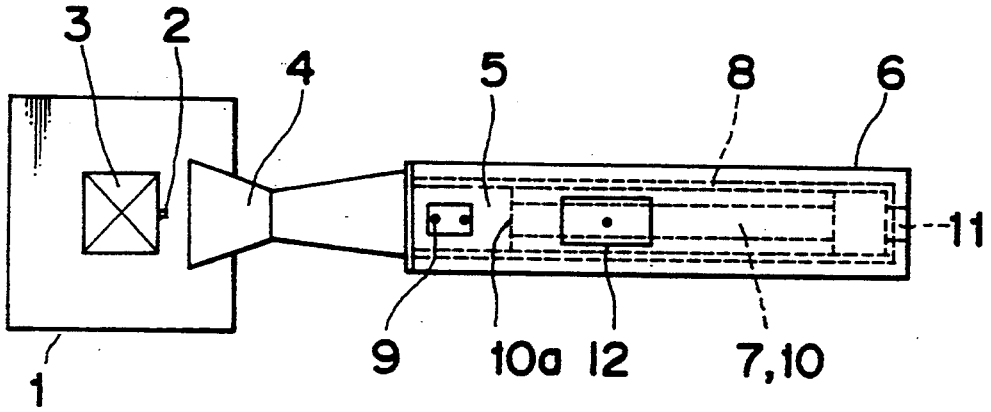
FIG. 10 is a plan view of the exothermic apparatus shown in FIG. 8.

A second embodiment of the present invention will be described below with reference to FIGS. 8, 9, and 10. FIG. 8 is a horizontal sectional view showing an exothermic apparatus according to a second embodiment of the present invention. FIG. 9 is a sectional view, showing the exothermic apparatus, taken along the line IX—IX of FIG. 8. FIG. 10 is a plan view of the exothermic apparatus shown in FIG. 8. The valve 3 provided between the bomb 1 containing liquefied gas such as propane gas, butane gas or the like and the nozzle 2 controls the flow rate of fuel gas supplied from the bomb 1. The fuel gas jetted from the nozzle 2 draws air in the periphery of the nozzle 2 due to the inducing operation of the flow of the fuel gas. Air and the fuel gas are uniformly mixed with each other in the mixing chamber 4, and the mixture of air and the fuel gas is supplied to the combustion chamber 5. The combustion chamber 5 is disposed inside the exothermic section 6 comprising a metal casing. A plurality of fins 7 disposed inside the combustion chamber 5 is substantially parallel with the flow direction of the mixed gas so as to increase the surface area in the combustion chamber 5 without changing the size of the combustion chamber 5.

The catalyst layer 8 disposed in the combustion chamber 5 is in close contact with the inner surface thereof. The catalyst held on the catalyst layer 8 is selected from the elements of the platinum group and metal oxides of nickel, cobalt, iron, manganese, chrome and the like. The elements of the platinum group such as platinum, palladium, and rhodium are most favorably used as the material of the catalyst. If the thickness of the catalyst layer 8 is very great, it is difficult for the combustion heat generated over the catalyst layer 8 to be supplied to the exothermic section 6. If the thickness of the catalyst layer 8 is very small, the combustion heat generated on the catalyst layer 8 is easily transmitted to the exothermic section 6, thus causing the temperature of the catalytic combustion to drop. As a result, the mixed gas tends to burn unfavorably. Therefore, preferably, the thickness of the catalyst layer 8 ranges from 0.3 mm to 2.0 mm.

An ignition heater 9 made of a fine platinum wire is heated by a battery (not shown), and the catalyst layer 8 close to the ignition heater 9 is heated to a high temperature. When the catalyst layer 8 is heated to an active temperature, the valve 3 is opened, thus supplying the fuel gas to the mixing section 4 via the nozzle 2. The operation is performed at this time by monitoring the temperature in the combustion chamber 5 or opening the valve 3 a certain period of time after electricity is supplied to the ignition heater 9. The fuel gas and air are mixed with each other in the mixing section 4 and the mixed gas is supplied to the combustion chamber 5. When the mixed gas is supplied to the surface of the catalyst layer 8 heated to the active temperature, the mixed gas starts burning on the surface of the catalyst layer 8. In the neighborhood of the combustion chamber 5, the mixed gas supplied to the vicinity of the inner surface of the combustion chamber 5 burns while the mixed gas supplied to the vicinity of the center of the combustion chamber 5 passes through the combustion chamber 5 without burning. Accordingly, gas which has burned flows in the vicinity of the inner surface of the combustion chamber 5, whereas the mixed gas flows in the vicinity of the center of the combustion chamber 5.

The fin 7 provided inside the combustion chamber 5 is substantially parallel with the flow direction of the mixed gas. A catalyst layer 10 is in close contact with the outer surface of the fin 7. Therefore, the mixed gas collides with a burning surface 10*a* of the fin 7 and as a result, unburned gas of the mixed gas partly burns on the burning surface 10*a*. There occurs a mixture between the gas which has burned on the burning surface 10*a* as well as in the vicinity of the entrance of the combustion chamber 5 and the unburned fuel gas. The mixed gas flows between the catalyst layer 10 in close contact with the outer surface of the fin 7 and the catalyst layer 8 in close contact with the inner surface of the combustion chamber 5. As a result of the mixture between the gas which has burned and has a high temperature and the unburned fuel gas, the temperature of the fuel gas becomes high. While the fuel gas which has become high in temperature is flowing in the narrow gap between the catalyst layers 8 and 10, all the unburned combustion gas burns substantially. Since the fins 7 provided in the combustion chamber 5 are substantially parallel with the flow direction of the mixed gas, premixed gas passes through the combustion chamber 5 with the fin 7 dispersing the mixed gas substantially uniformly in the combustion chamber 5. As a result, the premixed gas contacts the surface of the catalyst efficiently. Accordingly, almost all the premixed gas is discharged from the combustion chamber 5 after contacting the surface of the catalyst. Thus, the combustion efficiency in the combustion chamber 5 can be greatly improved. The fins 7 are provided alternately on the upper and lower surfaces thereof. Consequently, the premixed gas can be dispersed to a great extent and contacts the surface of the catalyst with a high efficiency. Thus, the combustion efficiency in the combustion chamber 5 is preferable. In the second embodiment, the combustion chamber 5 is small and thus the exothermic apparatus is compact and yet the combustion quantity thereof is large.

The combustion efficiency of the mixed gas is unfavorable if the gap between the catalyst layers 8 and 10 is very large. A fiber porous material was adhered to a combustion chamber made of aluminum with the gap between the catalyst layer 8 and the catalyst layer 10 varied as an experiment. It was found that a great combustion efficiency was obtained when the gap was less than 4 mm.

Since the gas which has burned on the surface of the catalyst flows in the narrow gap between the catalyst layers 8 and 10, the gas flows fast and thus the heat generated as a result of the combustion of the gas is transferred to the exothermic section 6 with a high efficiency.

In catalytic combustion, the mixed gas burns on the surface of the catalyst and thus the temperature at which the mixed gas burns on the catalyst surface has a great influence on the combustion characteristic thereof. Since heat quantity is supplied from the outer surface of the combustion chamber 5 to the exothermic section 6 as well as a material to be heated, the temperature at which the mixed gas burns on the surface of the catalyst layer 8 may be changed according to the fluctuation of heating amount supplied to the material to be heated. Not only the combustion heat generated on the inner surface of the combustion chamber 5, but also the combustion heat generated on the surface of the catalyst layer 10 in close contact with the outer surface of the fin 7 is transferred to the exothermic section 6 disposed on the outer surface of the combustion chamber 5 via the fin 7, thus contributing-to the heating of the material to be heated. Since the catalyst layer 10 in close contact with the outer surface of the fin 7 is not in contact with the exothermic section 6, the catalyst layer 10 is hardly subjected to the influence of the fluctuation in the heating amount supplied to the exothermic section 6, and thus the surface of the catalyst layer 10 is kept at a high temperature. Accordingly, the mixed gas is allowed to burn reliably on the surface of the catalyst layer 10. Further, there is a supply of the combustion heat from the surface of the catalyst layer 10 on which the mixed gas burns at a high temperature to the catalyst layer 8 in close contact with the inner surface of the combustion chamber 5 as radiation heat. Consequently, the fluctuation in the combustion temperature of the catalyst layer 8 can be prevented notwithstanding the fluctuation in the heating amount supplied to the material to be heated.

The gas which has burned cleanly in the combustion chamber 5 is discharged from a discharge opening 11. A temperature detecting section 12 is provided in the exothermic section 6. The temperature detecting section 12 has a function of adjusting the combustion quantity of the mixed gas. That is, the temperature detecting section 12 monitors the temperature of the exothermic section 6 and transmits a signal indicating the temperature thereof to the valve 3 so as to adjust the opening of the valve 3. Consequently, the surface temperature of the exothermic section 6 is maintained constant and thus the material can be heated at an appropriate temperature.

As shown in FIG. 9, a gap is provided between an end of the fin 7 disposed inside the combustion chamber 5 and the inner surface of the combustion chamber 5 so as to form a gap between the upper surface 10*b* of the catalyst layer 10 and the catalyst layer 8 in close contact with the inner surface of the combustion chamber 5. In this manner, the heat generated by the combustion of the mixed gas is supplied as radiation heat from the catalyst layer 10 in contact with the end of the fin 7 to the catalyst layer 8. Further, since the fins 7 are provided alternately on the upper and lower surfaces thereof, radiation heat generated over the catalyst layer 10 in contact with the fin 7 is supplied from the catalyst layer 10 to the inner surface of the combustion chamber 5. Thus, the temperature of the catalyst layer 8 can be prevented from fluctuating even though the heating amount supplied to the material to be heated fluctuates. In this manner, the temperature at which the mixed gas burns on the surface of the catalyst layer can be prevented from dropping and the activity of the catalyst can be maintained.

Accordingly, the combustion characteristic of the mixed gas can be favorably maintained even though the heating amount supplied to the material is varied. Although the combustion chamber 5 provides a high combustion quantity, the combustion chamber 5 is small and thus the exothermic apparatus is compact.

As described above, according to the second embodiment, the exothermic apparatus comprises: a mixing section in which the fuel gas and air are mixed with each other; and a casing, disposed downstream of the mixing section, accommodating the combustion chamber. In this construction, a plurality of fins is provided alternately on the upper surface of the combustion chamber and the lower surface thereof in such a manner that the fins are substantially parallel with the flow direction of mixed gas; the gap is provided between the end of each fin and the upper surface of the combustion chamber as well as the lower surface thereof; and the catalyst layer is formed in close contact with the inner surface of the combustion chamber and the outer surface of the fin. Accordingly, the fuel gas can be brought in contact with the surface of the catalyst layer efficiently. Further, the fluctuation in the temperature of the catalyst layer can be prevented even though the heating amount supplied to the exothermic section varies. Thus, a compact exothermic apparatus can be manufactured.

Figure 11:
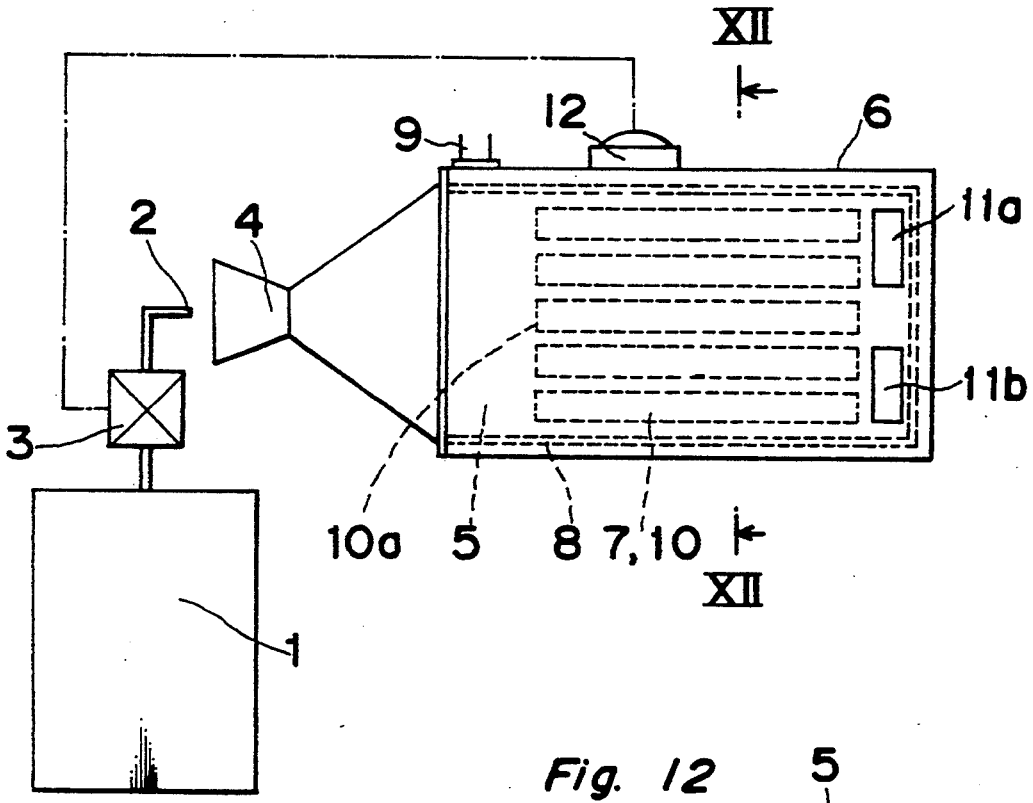
FIG. 11 is a plan view showing an exothermic apparatus according to a third embodiment of the present invention.
Figure 12:
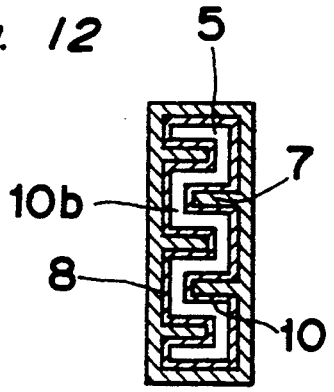
FIG. 12 is a sectional view, showing the exothermic apparatus, taken along a line XII—XII of FIG. 11.
Figure 13:
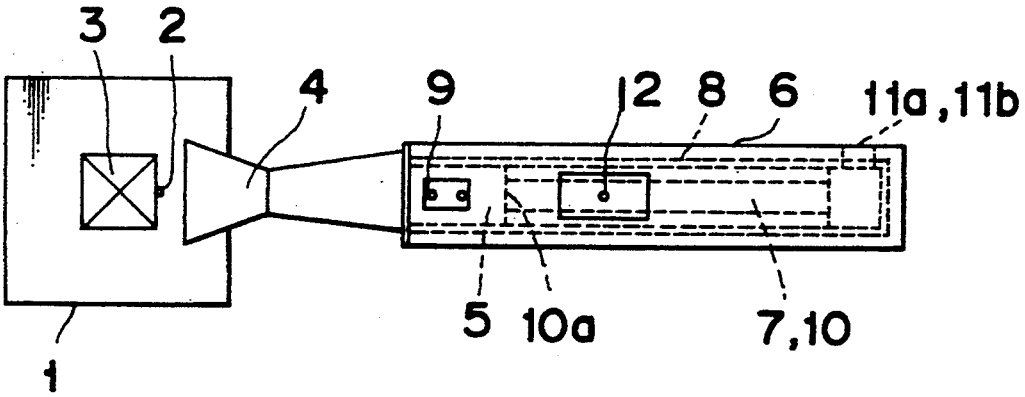
FIG. 13 is a side elevation of the exothermic apparatus shown in FIG. 11.

The third embodiment of the present invention will be described below with reference to FIGS. 11, 12, and 13. FIG. 11 is a plan view showing an exothermic apparatus according to a third embodiment of the present invention. FIG. 12 is a sectional view, showing the exothermic apparatus, taken along the line XII—XII of FIG. 11. FIG. 13 is a side elevation of the exothermic apparatus shown in FIG. 11. As shown in FIGS. 11 and 13, a discharge opening is not formed on the inner surface of the combustion chamber 5, opposed to the gas entrance of the mixing chamber 4. A pair of discharge openings 11*a* and 11*b* symmetrical with respect to the center of the combustion chamber 5 is formed in the vicinity of the inner surface of the combustion chamber 5 opposed to (i.e. at an end there of opposite) the gas entrance of the combustion chamber 5. The discharge openings 11*a* and 11*b* are perpendicular to the flow direction of the mixed gas.

The catalyst layer 8 disposed in the combustion chamber 5 is in close contact with the inner surface thereof. The catalyst of the catalyst layer 8 is selected from the elements of the platinum group and metal oxides of nickel, cobalt, iron, manganese, chrome and the like. The elements of the platinum group such as platinum, palladium, and rhodium are most favorably used as the material of the catalyst. If the thickness of the catalyst layer 8 is very great, it is difficult for the combustion heat generated over the catalyst layer 8 to be supplied to the exothermic section 6. If the thickness of the catalyst layer 8 is very small, the heat generated by the combustion of the mixed gas over the catalyst layer 8 is easily transmitted to the exothermic section 6, thus causing the combustion temperature in the catalytic combustion to drop. As a result, an unfavorable combustion occurs. Therefore, preferably, the thickness of the catalyst layer 8 ranges from 0.3 mm to 2.0 mm.

The operation is described below. An ignition heater 9 made of a fine platinum wire is heated by a battery (not shown) and the catalyst layer 8 close to the ignition heater 9 is heated to a high temperature. When the catalyst layer 8 is heated to an active temperature, the valve 3 is opened, thus supplying the fuel gas to the mixing section 4 via the nozzle 2. The operation is performed at this time by monitoring the temperature in the combustion chamber 5 or opening the valve 3 a certain period of time after electricity is supplied to the ignition heater 9.

The fuel gas and air are mixed with each other in the mixing section 4 and the mixed gas is then supplied to the combustion chamber 5. When the mixed gas is supplied to the surface of the catalyst layer 8 heated to the active temperature, the mixed gas starts burning on the surface of the catalyst layer 8.

While the mixed gas supplied to the combustion chamber 5 flows inside the combustion chamber 5, catalytic combustion occurs with the mixed gas in contact the catalyst layer 8 kept at a high temperature. At a high speed, the mixed gas flows without contacting the catalyst layer 8. Accordingly, the mixed gas flows at a low speed in a laminar flow. Consequently, the mixed gas flow fast in the center region of the combustion chamber 5 while it flows slowly in the vicinity of the inner surface of the combustion chamber 5.

In the third embodiment, as described above, the discharge opening is not formed on the inner surface of the combustion chamber 5 in a position opposite the gas entrance of the mixing chamber 4. The discharge openings 11*a* and 11*b* symmetrical with respect to the center of the combustion chamber 5 are formed in the vicinity of the inner surface, of the combustion chamber 5 opposed to (i.e. at an end there of opposite) the gas entrance such that the discharge openings 11*a* and 11*b* are perpendicular to the flow direction of the mixed gas. That is, since the discharge opening is not disposed in the neighborhood of the combustion chamber 5, the resistance to the flow of the mixed gas is great in the vicinity of the center region, of the combustion chamber 5, in which the mixed gas flows fast. Consequently, the mixed gas flows slowly in this region. The discharge openings 11*a* and 11*b* are disposed in the vicinity, of the inner surface of the combustion chamber 5, in which the mixed gas flows slowly. As a result, the resistance to the flow of the mixed gas is small in the vicinity of the inner surface of the combustion chamber 5. As a result, the mixed gas flows faster in the vicinity of the inner surface of the combustion chamber 5 than in the vicinity of the center region thereof. That is, the original speed of the mixed gas and the resistance to the flow speed thereof offset each other in each region. As a result, the entire mixed gas flows at a uniform speed in the combustion chamber 5. Therefore, the catalytic combustion can be reliably accomplished.

Figure 14:
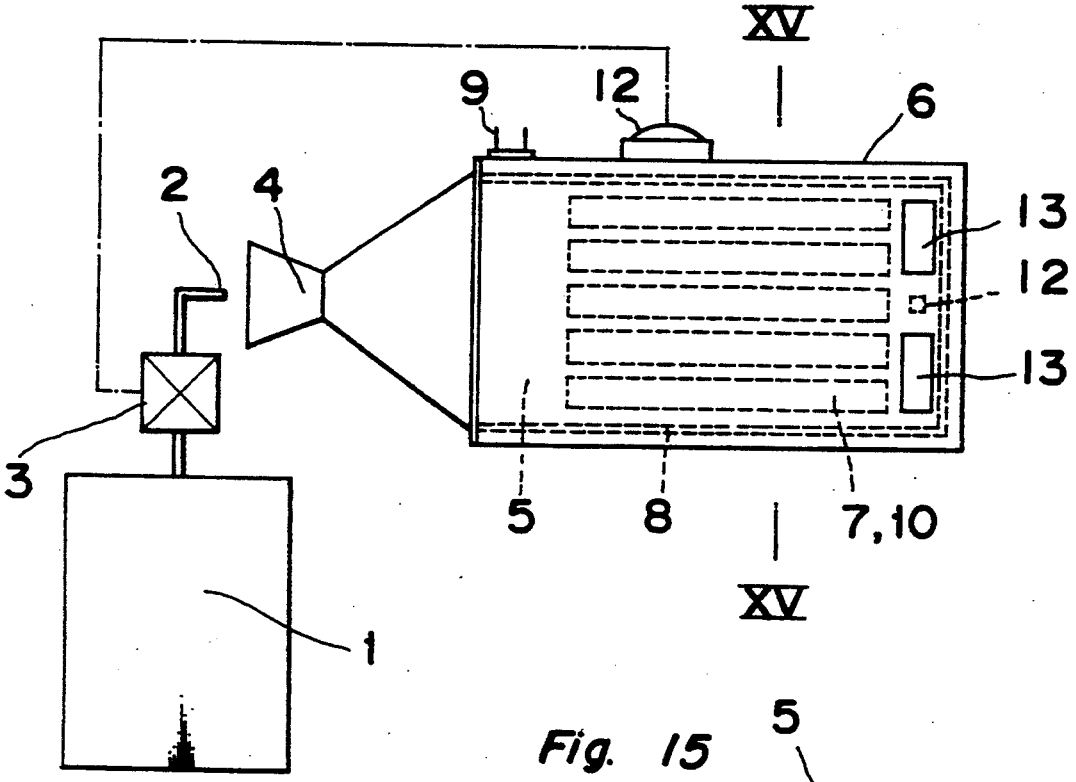
FIG. 14 is a plan view showing an exothermic apparatus according to a modification of the exothermic apparatus according to the third embodiment of the present invention.

An exothermic apparatus according to a modification of the exothermic apparatus according to the third embodiment is described below with reference to FIGS. 14, 15, and 16. As shown in FIGS. 14 and 16, an igniter 12 is formed on the inner surface, of the combustion chamber 5, opposed to the discharge openings 13 and 13 such that the igniter 12 is placed at a position intermediate between the discharge openings 13 and 13. That is, the igniter 12 is positioned in the vicinity of the inner surface, of the combustion chamber 5, opposed to the gas entrance of the combustion chamber 5 and is placed at a position intermediate between the discharge openings 13 and 13. Accordingly, the igniter 12 is positioned in the region in which the mixed gas is stagnant. Accordingly, a stabilized ignition operation can be accomplished.

Figure 15:
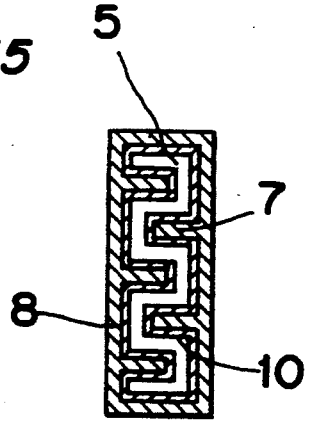
FIG. 15 is a sectional view, showing the exothermic apparatus, taken along a line XV—XV of FIG. 14.
Figure 16:
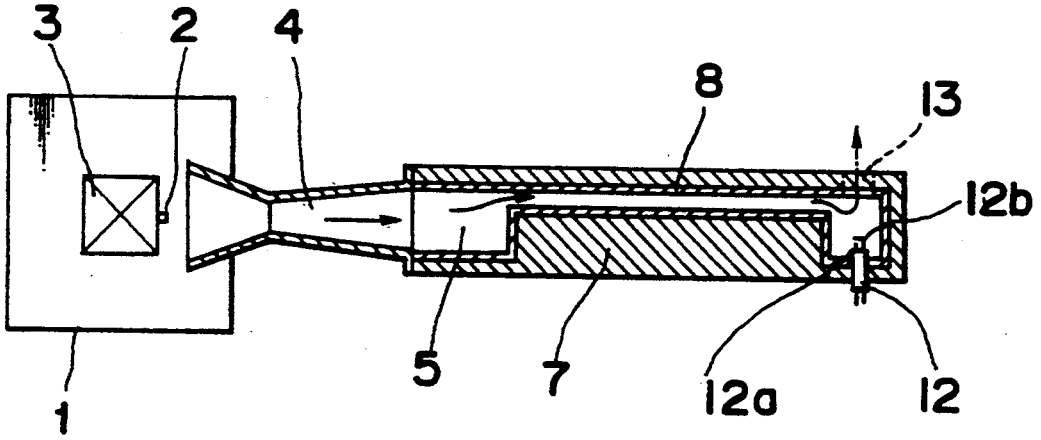
FIG. 16 is a sectional side elevation of the exothermic apparatus shown in FIG. 14.

FIG. 15 is a sectional view, showing the exothermic section of the exothermic apparatus, taken along the line XV—XV of FIG. 14.

As shown in FIG. 16, a discharge opening 13 is formed in the-vicinity of the inner surface, of the combustion chamber 5, opposed to the gas entrance such that the discharge opening 13 is perpendicular to the flow direction of the mixed gas. The igniter 12 is formed on the inner surface, of the combustion chamber 5, opposed to the discharge opening 13. Discharge is carried out between a plug 12*a* of the igniter 12 and a plug 12*b* opposed to the igniter 12 so as to ignite the mixed gas. As a result, catalytic combustion of the mixed gas occurs.

Accordingly, the mixed gas can be reliably ignited without decreasing the area of the catalyst disposed on the inner surface, of the combustion chamber 5, opposed to the gas entrance. Accordingly, due to heat transfer and radiation, there occurs a supply of the combustion heat from the catalyst layer 8 having a high temperature and in close contact with the inner surface, of the combustion chamber 5, opposed to the gas entrance of the combustion chamber 5 to the catalyst layer 8 disposed at other places in the combustion chamber 5. In this combustion control of the modification, the position at which catalytic combustion starts earliest is the catalyst layer in close contact with the inner surface, of the combustion chamber 5, opposed to the gas entrance most downstream of the combustion chamber 5. Therefore, when the fuel gas is supplied from the catalyst layer 8 to the combustion chamber 5, radiation heat is uniformly supplied to the other catalyst layer. In this manner, the mixed gas disposed over the other catalyst layer 8 starts combustion rapidly.

In order to ensure that the mixed gas can be reliably ignited, preferably, the plug 12*a* of the igniter 12 is disposed in the stagnant region of the mixed gas. In the modification of the third embodiment, the stagnant region is generated between the discharge opening 13 and the inner surface, of the combustion chamber 5, opposed to the gas entrance. Therefore, ignition can be accomplished reliably by disposing the igniter 12 in this region.

As described above, according to the third embodiment, the exothermic apparatus comprises: the mixing chamber in which the fuel gas and air are mixed with each other; the combustion chamber, provided downstream of the mixing chamber, in which the catalyst layer composed of a ceramic coating layer containing catalyst metal is in close contact with the inner surface thereof; and the casing accommodating the combustion chamber. In this construction, two discharge openings perpendicular to the flow direction of mixed gas and symmetrical with respect to the center of the combustion chamber is disposed in the vicinity of the inner surface, of the combustion chamber, opposed to an entrance of the mixed gas.

According to this construction, the fuel gas flows in the combustion chamber at a uniform speed. Therefore, a reliable catalytic combustion can be accomplished in the combustion chamber.

In addition, there is also provided the exothermic apparatus comprising: the mixing chamber in which the fuel gas and air are mixed with each other; the combustion chamber, provided downstream of the mixing chamber, in which the catalyst layer composed of the ceramic coating layer containing catalyst metal is in close contact with the inner surface thereof; and the casing accommodating the combustion chamber. In this construction, the discharge opening perpendicular to the flow direction of mixed gas is disposed in the vicinity of the inner surface, of the combustion chamber, opposed to the gas entrance; and the igniter is provided on the inner surface, of the combustion chamber, opposed to the discharge opening.

According to this construction, catalytic combustion can be started rapidly and the control of the combustion amount can be performed with a high response.

Figure 17:
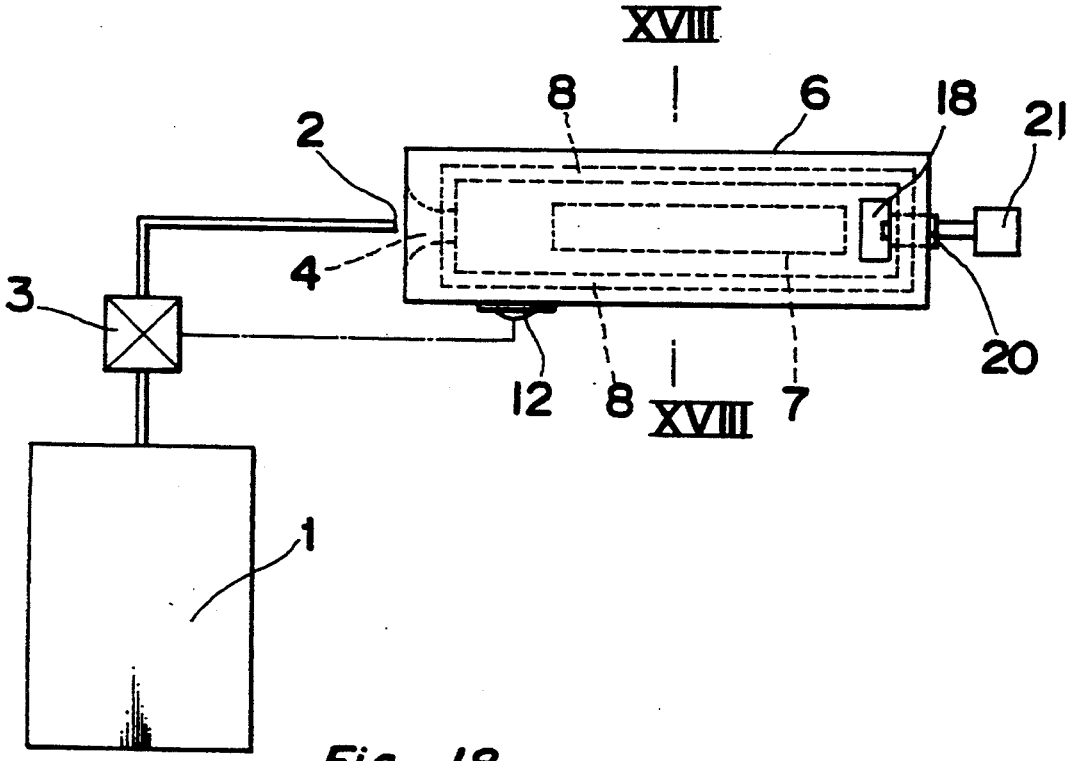
FIG. 17 is a plan view showing an exothermic apparatus according to a fourth embodiment of the present invention.
Figure 18:
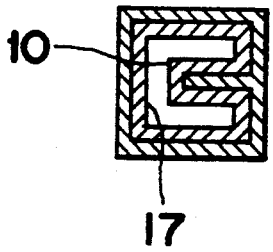
FIG. 18 is a sectional view, showing the exothermic apparatus, taken along a line XVIII—XVIII of FIG. 17.
Figure 19:
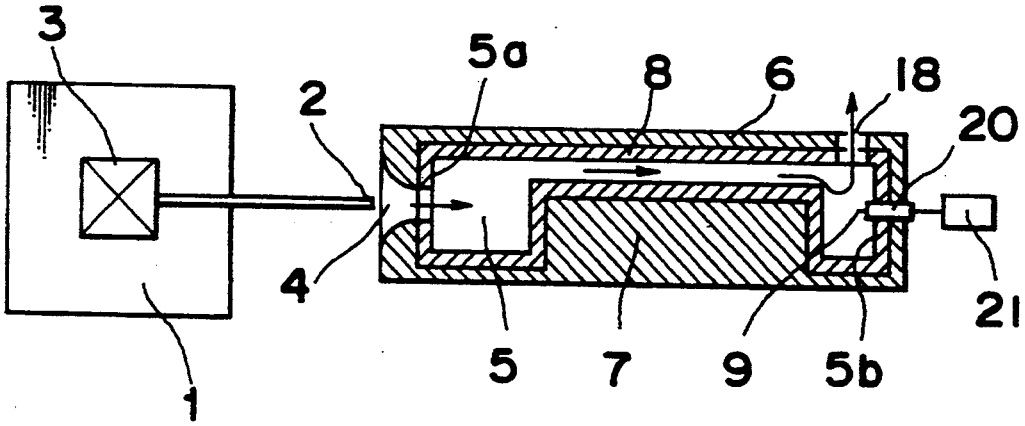
FIG. 19 is a sectional side elevation of the exothermic apparatus shown in FIG. 17.

The fourth embodiment of the present invention will be described below with reference to FIGS. 17, 18, and 19. FIG. 17 is a plan view showing an exothermic apparatus according to the fourth embodiment of the present invention. FIG. 18 is a sectional view, showing the exothermic apparatus, taken along the line XVIII—XVIII of FIG. 17. FIG. 19 is a sectional side elevation of the exothermic apparatus shown in FIG. 17. The valve 3 provided between the bomb 1 containing liquefied gas such as propane gas, butane gas or the like and the nozzle 2 controls the flow rate of fuel gas supplied from the bomb 1. The fuel gas jetted from the nozzle 2 draws air in the periphery of the nozzle 2 due to the inducing operation of the flow of the fuel gas. Air and the fuel gas are uniformly mixed with each other in the mixing chamber 4 and the mixture of air and the fuel gas is supplied to the combustion chamber 5. The combustion chamber 5 is disposed inside the exothermic section 6 comprising a metal casing. The catalyst layer 8 is provided on the inner surface of the combustion chamber 5.

The operation is described below. The valve 3 is opened to supply the mixed gas from the nozzle 2 to the mixing chamber 4. Air drawn in by the jetting force of the fuel gas and the fuel gas are mixed with each other in the mixing section 4 and the mixed gas is then supplied to the combustion chamber 5.

The mixed gas supplied from the entrance 5*a* of the combustion chamber 5 flows through the combustion chamber 5, thus colliding with an inner surface 5*b*, of the combustion chamber 5, opposed to the entrance 5*a* thereof and is discharged from a discharge opening 18. At this time, a stagnant region in which the mixed gas flows very slowly is generated in the vicinity of the inner surface 5*b* with which the mixed gas has collided. An igniter 20 is disposed in the vicinity of the inner surface 5*b* so that the leading end of a plug 9 is disposed in the stagnant region. Upon supply of a high voltage to the igniter 20 from a high voltage transformer 21, sparks are generated from the leading end of the plug 9. A piezoelectric element may be used instead of the high voltage transformer 21.

As soon as the mixed gas reaches the leading end of the plug 9, the mixed gas is ignited because the leading end thereof is disposed in the stagnant region. While flame of a high temperature generated by the plug 9 is propagating upstream in the combustion chamber 5, the catalyst layer 8 in close contact with the inner surface of the combustion chamber 5 is heated. Since the igniter 20 is placed at a downstream end of the combustion chamber 5, the flame heats other catalyst layers 8. As a result, all the catalyst layers 8 in the combustion chamber 5 are heated to an active temperature in a short period of time and thus catalytic combustion occurs. Then, gas which has burned is discharged from the discharge opening 18.

Since the catalyst layer 8 is heated by utilizing the propagation of flame, the catalyst layer 8 attains the active temperature in a short period of time.

The temperature detecting section 12 is provided in the exothermic section 6. The temperature detecting section 12 has a function of adjusting combustion quantity. That is, the temperature detecting section 12 monitors the temperature of the exothermic section 6 and transmits a signal indicating the temperature to the valve 3 so as to adjust the opening of the valve 3. In this manner, the combustion quantity is adjusted. Consequently, the surface of the exothermic section 6 is kept at a constant temperature and thus the material can be heated at an appropriate temperature.

Figure 20:
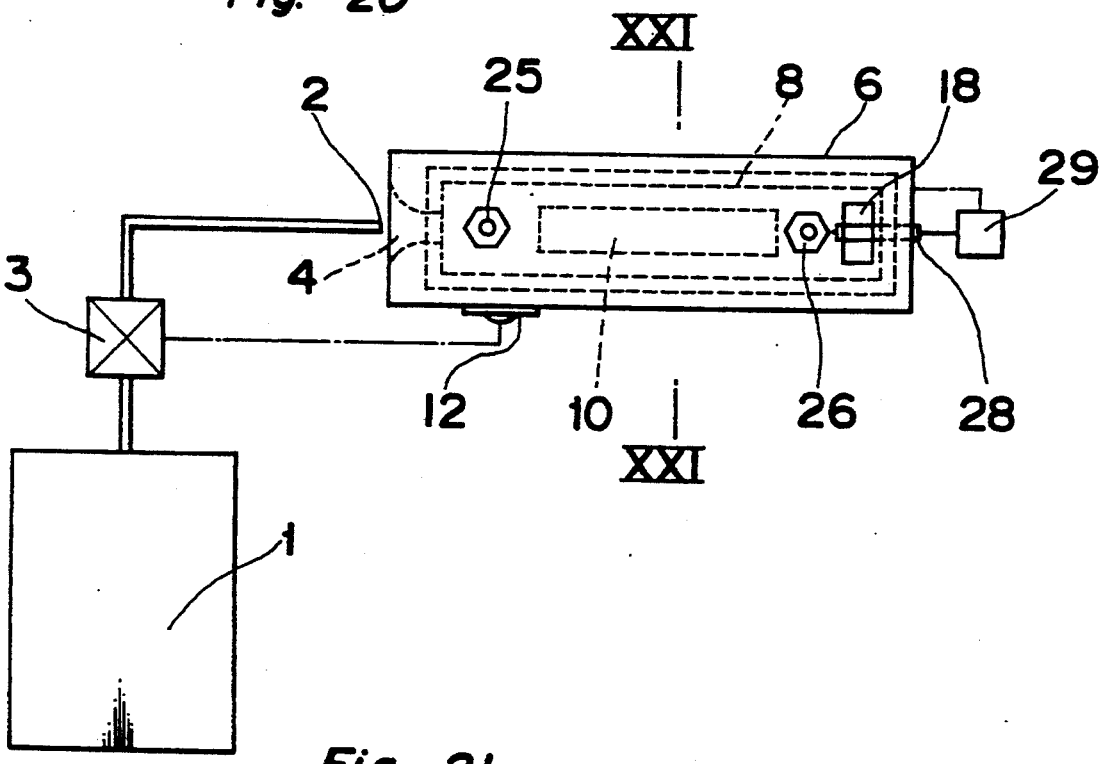
FIG. 20 is a plan view showing an exothermic apparatus according to a first modification of the exothermic apparatus according to the fourth embodiment of the present invention.
Figure 21:
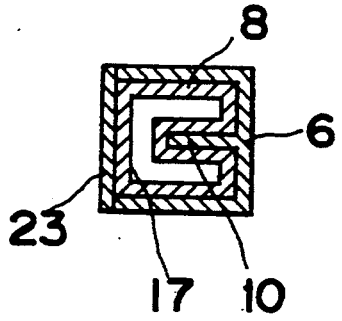
FIG. 21 is a sectional view, showing the exothermic apparatus, taken along a line XXI—XXI of FIG. 20.
Figure 22:
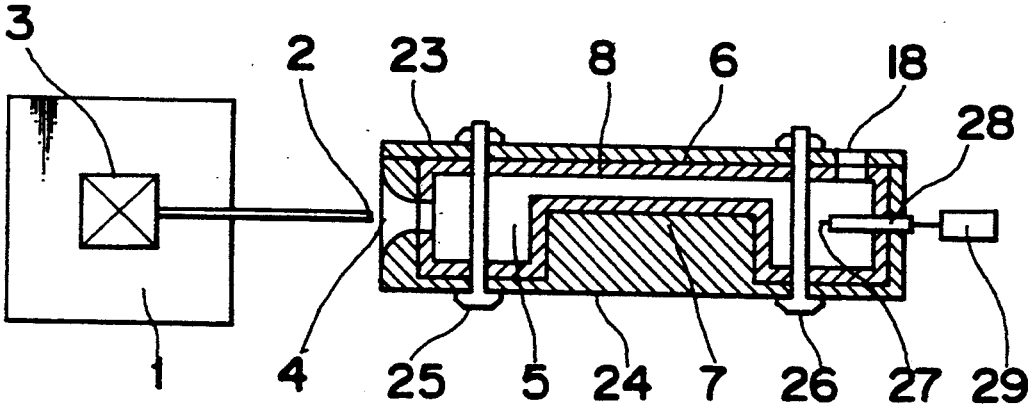
FIG. 22 is a sectional side elevation of the exothermic apparatus shown in FIG. 20.

With reference to FIGS. 20, 21, and 22, an exothermic apparatus according to a first modification of the exothermic apparatus according to the fourth embodiment is described below. FIG. 20 is a plan view showing the exothermic apparatus according to the first modification of the fourth embodiment of the present invention. FIG. 21 is a plan view, showing the exothermic apparatus, taken along the line XXI—XXI of FIG. 20. FIG. 22 is a sectional side elevation of the exothermic apparatus shown in FIG. 20. Referring to FIG. 20, the combustion chamber 5 comprises two exothermic sections 23 and 24 fixed to the combustion chamber 5 by means of bolts 25 and 26. The bolt 26 disposed downstream of the combustion chamber 5 is disposed in the vicinity of the discharge opening 18. In addition to fixing the exothermic sections 23 and 24, the bolts 25 and 26 obstruct the flow of the mixed gas in the combustion chamber 5. As a result, a stagnant region is generated downstream of the bolts 25 and 26. An igniter 28 is disposed in the vicinity of the inner surface **5*b* of the combustion chamber 5 so that the leading end of a plug 27 is positioned in the stagnant region downstream of the bolt 26. When the grounding side of a high voltage transformer 29 is connected with the exothermic section 23, sparks are generated between the plug 27 and the bolt 26**.

Since the region in which sparks are generated is the stagnant region downstream of the bolt 26, the mixed gas can be readily ignited. That is, as soon as the mixed gas reaches the stagnant region, the mixed gas is ignited. While flame of a high temperature generated by the plug 9 is propagating upstream in the combustion chamber 5, the catalyst layer 8 in close contact with the inner surface of the combustion chamber 5 is heated. The bolt 26 is disposed in the vicinity of the discharge opening 18, and the igniter 27 is placed in a downstream end of the combustion chamber 5. Accordingly, flame propagating in the combustion chamber 5 heats other catalyst layers 8. Consequently, the catalyst layers 8 in the combustion chamber 5 are heated to the active temperature in a short period of time and thus catalytic combustion occurs. Then, gas which has burned is discharged from the discharge opening 18.

Since the catalyst layer 8 is heated by utilizing the propagation of flame, the catalyst layer 8 attains the active temperature in a short period of time.

The temperature detecting section 12 is provided in the exothermic section 6. The temperature detecting section 12 has a function of adjusting combustion quantity. That is, the temperature detecting section 12 monitors the temperature of the exothermic section 6 and transmits a signal indicating the temperature to the valve 3 so as to adjust the opening of the valve 3. In this manner, the quantity of gas supplied from the bomb 1 is changed to adjust the combustion quantity. Consequently, the surface of the exothermic section 6 is kept at a constant temperature and thus the material can be heated at an appropriate temperature.

Figure 23:
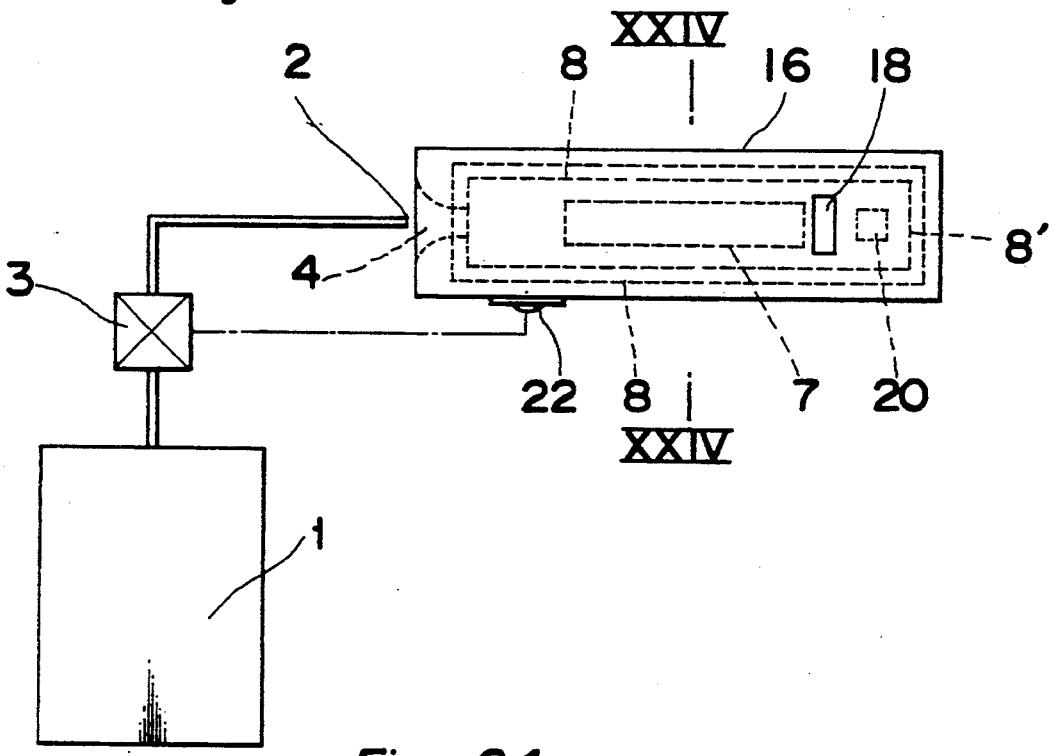
FIG. 23 is a plan view showing an exothermic apparatus according to a second modification of the exothermic apparatus according to the fourth embodiment of the present invention.
Figure 24:
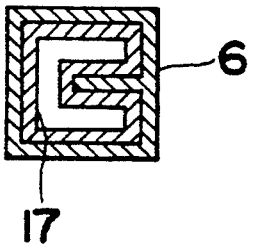
FIG. 24 is a sectional view, showing the exothermic apparatus, taken along a line XXIV—XXIV of FIG. 23.
Figure 25:
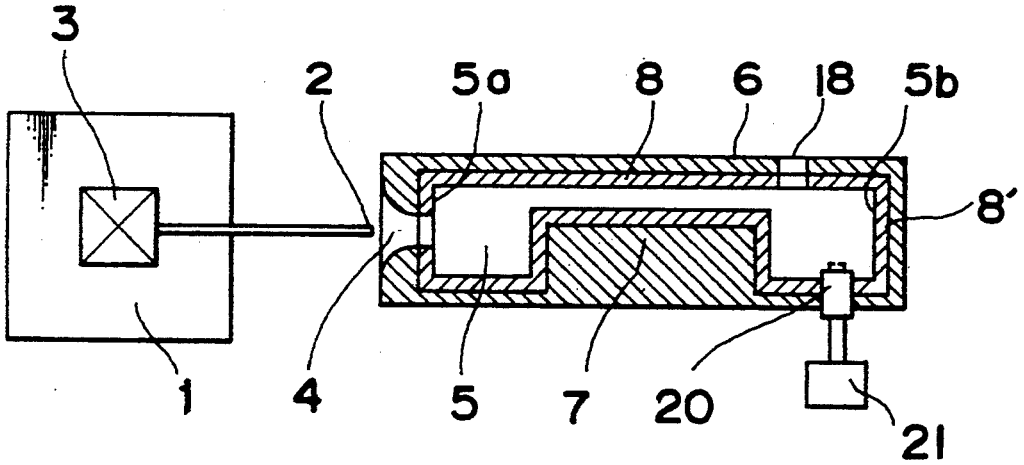
FIG. 25 is a sectional side elevation of the exothermic apparatus shown in FIG. 23.

With reference to FIGS. 23, 24, and 25, an exothermic apparatus according to a second modification of the exothermic apparatus according to the fourth embodiment is described below. FIG. 23 is a plan view showing the exothermic apparatus according to the second modification. FIG. 24 is a sectional view, showing the exothermic apparatus, taken along the line XXIV—XXIV of FIG. 23. FIG. 25 is a sectional side elevation of the exothermic apparatus shown in FIG. 23. Referring to FIG. 25, a ceramic coating layer (catalyst layer) 8' in close contact with the inner surface **5*b*, of the combustion chamber 5, opposed to the gas entrance 5*a* is thicker than a ceramic coating layer (catalyst layer) 8 in close contact with an inner surface, of the combustion chamber 5, different from the inner surface 5*b*. The ceramic coating layer containing a catalyst metal consists of active alumina or a material composed of active alumina applied to paper-shaped or felt-shaped ceramic. The thicker the ceramic coating layer, the higher is the heat-insulating effect thereof. If the thickness of the ceramic coating layer is very great, it is difficult for the combustion heat of the mixed gas generated on the ceramic coating layer to be supplied to the exothermic section 6. If the thickness of the ceramic coating layer is very small, the combustion heat of the mixed gas generated on the ceramic coating layer is easily transmitted to the exothermic section 6, thus causing the combustion temperature in catalytic combustion to be dropped. As a result, an unfavorable combustion occurs. Therefore, preferably, the thickness of the ceramic coating layer 8 ranges from 0.3 mm to 2.0 mm and thus the thickness of the ceramic coating layer 8' (catalyst layer) ranges from 1.0 mm to 3.0 mm so as to allow the ceramic coating layer 8' to have a higher heat-insulating effect than the ceramic coating layer 8. If the thickness of the ceramic coating layer 8' is greater than 3.0 mm, combustion heat is hardly supplied to the exothermic section 6** and thus there is a possibility that the temperature of the catalyst will become high.

When it is detected that the temperature of the exothermic section 6 has risen higher than a predetermined temperature in response to a signal transmitted from the temperature detecting section 12 of the exothermic section 6, the valve 3 is closed to stop the supply of the fuel gas to the combustion chamber 5. When it is detected that the temperature of the exothermic section 6 has become lower than the predetermined temperature in response to a signal transmitted from the temperature detecting section 12, the valve 3 is opened to start the supply of the fuel gas to the combustion chamber 5. The fuel gas supplied to the combustion chamber 5 is mixed with air in the mixing section 4 and premixed gas thus formed flows into the combustion chamber 5. The ceramic coating layer of the catalyst layer 8' in close contact with the inner surface **5*b*, of the combustion chamber 5, opposed to the gas entrance 5*a* is thicker than the catalyst layer 8 of the combustion chamber 5. Therefore, when the premixed gas flows into the combustion chamber 5 again, the temperature of the catalyst layer 8' drops to a smaller degree than that of the catalyst layer 8** when catalytic combustion is stopped.

Accordingly, the premixed gas supplied to the combustion chamber 5 flows therein. As soon as the premixed gas collides with the inner surface **5*b* opposed to the gas entrance 5***a* of the combustion chamber 5, the catalytic combustion of the premixed gas starts on the catalyst layer 8′ earlier than the other catalyst layer 8. Accordingly, the catalyst layer 8 can be rapidly heated by the heat and radiation supplied from the catalyst layer 8′ which is in close contact with the entrance 5*a* of the mixed gas and has been heated to a high temperature. According to the combustion control of the second modification, the position at which the mixed gas starts burning under the influence of the catalyst is constant when the fuel gas is supplied to the combustion chamber 5. In this manner, the combustion of the mixed gas can be reliably accomplished. Further since the mixed gas starts combustion on the catalyst layer 8′ in close contact with the inner surface 5*b* which is opposed to the entrance 5*a* and most downstream of the combustion chamber 5, the radiation heat of the catalyst layer 8′ is uniformly supplied to the other catalyst layer 8 in the combustion chamber 5 and the mixed gas disposed over the other catalyst layer 8 starts combustion rapidly.

As apparent from the above description, according to the second modification of the fourth embodiment, the exothermic apparatus comprises: the mixing section in which the fuel gas and air are mixed with each other; the combustion chamber, disposed downstream of the mixing section, in which the catalyst layer composed of the ceramic coating layer containing the catalyst metal is in close contact with the inner surface thereof; the casing accommodating the combustion chamber; and the discharge opening substantially perpendicular to the flow direction of the mixed gas. In this construction, the quantity of metal contained in a first catalyst layer formed on an inner surface, of the combustion chamber, opposed to a gas entrance contains metal is greater than that of metal contained in a second catalyst layer formed on other inner surface of the combustion chamber; or the ceramic coating layer of the first catalyst layer formed on the inner surface, of the combustion chamber, opposed to the gas entrance thereof is thicker than a second catalyst layer formed on other inner surface of the combustion chamber. Accordingly, catalytic combustion can be started reliably and rapidly. In addition, the control of the combustion amount can be made with a high response.

As described above, according to the fourth embodiment, the exothermic apparatus comprises: the mixing section in which the fuel gas and air are mixed with each other; the combustion chamber, disposed downstream of the mixing section, having the catalyst layer in close contact with the inner surface thereof; and the casing accommodating the combustion chamber. In this construction, the first igniter is provided on the inner surface, of the combustion chamber, opposed to the gas entrance thereof; the flow-obstructing section for obstructing the flow of the mixed gas is provided in the vicinity of the discharge opening provided inside the combustion chamber; and the second igniter is provided downstream of the flow-obstructing section. According to the above construction, the mixed gas is ignited by the igniter in the stagnant region in which the mixed gas flows very slowly. Since the catalyst layer is heated by utilizing the propagation of flame, the catalyst layer attains the active temperature in a short period of time.

Although the present invention has been fully described in connection with the preferred embodiments thereof with reference to the accompanying drawings, it will be apparent to those skilled in the art that many changes and modifications can be made. Such changes and modifications are to be understood as included within the scope of the present invention as defined by the appended claims unless they depart therefrom.

What is claimed is:

1. An exothermic apparatus comprising:

a casing including an outer wall and having a gas mixture inlet and a discharge outlet, said outer wall defining a combustion chamber therewithin, said outer wall having an interior surface and an exterior surface;

a gas-air mixing chamber mounted to said casing at said gas mixture inlet thereof for introducing a gas mixture into said combustion chamber so as to flow in a gas mixture flow direction toward said discharge outlet;

a fin fixed to a first interior surface portion of said outer wall of said casing and extending from said first interior surface portion and only part way across said combustion chamber toward a second interior surface portion of said outer wall of said casing, said second interior surface portion being disposed opposite said first interior surface portion, so as to form a gap between a tip end of said fin and said second interior surface portion of said outer wall of said casing, said fin being elongated along the gas mixture flow direction, and said tip end of said fin constituting a free end of said fin; and a catalyst layer formed on said interior surface of said outer wall and on an exterior surface of said fin.

2. An exothermic apparatus as recited in claim 1, further comprising a fuel supply tank; and a nozzle connected to said fuel supply tank and mounted adjacent said mixing chamber for introducing gas from said fuel supply tank into said mixing chamber.

3. An exothermic apparatus as recited in claim 2, further comprising a valve interposed between said fuel supply tank and said nozzle for controlling a rate of fuel flow from said fuel supply tank into said mixing chamber.

4. An exothermic apparatus as recited in claim 3, further comprising at least one additional fin respectively fixed to at least one of said first and said second interior surface portions of said outer wall of said casing and respectively extending from said at least one of said first and second interior surface portions and only part way across said combustion chamber toward the other of said first and second interior surface portions, said second interior surface portion being disposed opposite said first interior surface portion, so as to form a gap between a tip end of said at least one additional fin and said other of said first and second interior surface portions of said outer wall of said casing, said at least one additional fin being elongated along the gas mixture flow direction.

5. An exothermic apparatus as recited in claim 1, further comprising at least one additional fin respectively fixed to at least one of said first and said second interior surface portions of said outer wall of said casing and respectively extending from said at least one of said first and second interior surface portions and only part way across said combustion chamber toward the other of said first and second interior surface portions, said second interior surface portion being disposed opposite said first interior surface portion, so as to form a gap between a tip end of said at least one additional fin and said other of said first and second interior surface portions of said outer wall of said casing, said at least one additional fin being elongated along the gas mixture flow direction.

6. An exothermic apparatus comprising:

a casing including an outer wall and having a gas mixture inlet and a discharge outlet, said outer wall defining a combustion chamber therewithin, said outer wall having an interior surface and an exterior surface;

a gas-air mixing chamber mounted to said casing at said gas mixture inlet thereof for introducing a gas mixture into said combustion chamber so as to flow in a gas mixture flow direction toward said discharge outlet;

a plurality of fins fixed alternatingly to first and second interior surface portions of said outer wall of said casing, respectively, and extending from a respective one of said first and second interior surface portions and only part way across said combustion chamber toward a respective other of said first and second interior surface portions, said second interior surface portion being disposed opposite said first interior surface portion, so that a gap is formed between a tip end of each of said fins and said respective other of said first and second interior surface portions, each of said fins being elongated along the gas mixture flow direction; and a catalyst layer formed on said interior surface of said outer wall and on an exterior surface of each of said fins.

7. An exothermic apparatus as recited in claim 6, further comprising a fuel supply tank; and a nozzle connected to said fuel supply tank and mounted adjacent said mixing chamber for introducing gas from said fuel supply tank into said mixing chamber.

8. An exothermic apparatus as recited in claim 7, further comprising a valve interposed between said fuel supply tank and said nozzle for controlling a rate of fuel flow from said fuel supply tank into said mixing chamber.

* * * * *